United States Patent [19]

Lazzeroni et al.

[11] Patent Number: 4,979,586

[45] Date of Patent: Dec. 25, 1990

[54] ACOUSTICALLY SHIELDED MOTORCYCLE HELMET SPEAKER ENCLOSURE

[76] Inventors: John J. Lazzeroni; Melinda K. Lazzeroni, both of 7322 E. Stella Rd., Tucson, Ariz. 85703

[21] Appl. No.: 444,314

[22] Filed: Dec. 1, 1989

[51] Int. Cl.[5] ..... H05K 5/00

[52] U.S. Cl. ..... 181/129; 181/150; 181/151; 181/153; 181/155; 181/199; 381/158; 381/160; 381/183; 381/187; 381/188; 381/189; 381/205

[58] Field of Search ..... 181/129, 137, 150–153, 181/155, 199; 381/153, 182, 187, 188, 189, 205, 158, 160, 183

[56] References Cited

U.S. PATENT DOCUMENTS

| | | | |
|---|---|---|---|
| 1,085,916 | 2/1914 | Hutchison . | |
| 2,403,418 | 7/1946 | Volkmann | 181/129 |
| 2,862,071 | 11/1958 | Bonnaffous | 381/187 |
| 3,021,526 | 2/1962 | Lastnik | 181/129 X |
| 3,549,831 | 12/1970 | Forney | 455/1 |
| 3,586,977 | 6/1971 | Lustig | 455/95 |
| 3,602,329 | 8/1971 | Bauer et al. | 181/129 |
| 3,916,312 | 10/1975 | Campbell | 455/89 |
| 4,424,880 | 1/1984 | Murayama | 181/129 |
| 4,491,699 | 1/1985 | Walker | 379/174 |

FOREIGN PATENT DOCUMENTS

| | | |
|---|---|---|
| 1953337 | 9/1971 | Fed. Rep. of Germany . |
| 2921434 | 11/1980 | Fed. Rep. of Germany . |
| 2005958 | 4/1979 | United Kingdom . |

*Primary Examiner*—Benjamin R. Fuller
*Attorney, Agent, or Firm*—J. Michael McClanahan

[57] ABSTRACT

An acoustically shielded speaker enclosure for use in the ear pockets of motorcycle helmets is disclosed wherein parasitic sound waves emitted from the rear side of an enclosed audio loudspeaker are prevented from entering the motorcycle rider's ear and from mixing with and distorting the primary sound waves issued from the audio loudspeaker directed at the rider's ear. The acoustically shielded speaker enclosure consists of a pair of joined together cup-shaped housing assemblies forming a shortened cylinder adapted to enclose and secure an audio loudspeaker, the enclosure having openings in one face of the housing assemblies to allow passage of the primary sound waves from the contained loudspeaker. An acoustic shield attached to the speaker enclosure cylindrical side extends to the edge of the ear pocket and is sealed there. The parasitic sounds emanating from the rear of the loudspeaker through the rear of the speaker enclosure are this prevented from coming around the speaker enclosure by the acoustic shield to enter the rider's ear or to mix with and distort the primary sound waves.

18 Claims, 1 Drawing Sheet

ACOUSTICALLY SHIELDED MOTORCYCLE HELMET SPEAKER ENCLOSURE

BACKGROUND OF THE INVENTION

1. Field of the Invention.

The field of the invention is audio loudspeaker enclosures fitting within the ear pockets of motorcycle helmets or helmets worn in a noisy or windy environment.

2. Description of the Related Art. In recent years, motorcycle riders have enjoyed vast improvements in communications. This is especially true in respect to communications between the motorcycle driver and passengers as well as other motorcycle drivers and passengers, all while the motorcycles are moving. Such improvements include the installation of microphones proximate the rider's and passenger's mouth by attachment to the motorcycle helmet (or within the helmet itself in the case of a full face helmet), as well as the installation of headsets or earphones in both their helmets.

As might well be apparent, the motorcycle driver and passenger are exposed to vast amounts of noise ever present in their immediate environment. In addition to the noise of the motorcycle engine, the road sounds, i.e., sounds of the tires engaging the road, sounds of nearby vehicles including emergency vehicle sirens, the motorcycle rider and passenger are also bothered with the sounds of air rushing past the motorcycle, and past the body, face, and ears. The motorcycle helmet presents a very special environment in which sound enters the rider's ears, both from outside the helmet and also from within the helmet from the speakers or earphones contained therein.

An electronic circuit connecting to the microphone must, as far as possible, not amplify for transmission the sounds entering the microphone except for the driver's and passenger's speech. Similarly, the sound emitted from the earphones located in the helmets must enter the ear with maximum clarity and minimum distortion as much as possible, at least with respect to factors controllable in construction of the earphones and helmet.

In today's helmets, it is common to line the inside of the helmet with a layer of cushioning material, commonly styrene, and then cover the cushioning material with cloth or other similar lining material. In many cases, the cushioning material may have a thickness of ½ to 1 inch. Because people's ears tend to protrude from the head a short distance, it is common to place ear pockets in the cushioning material and liner, ear pockets merely being a cavity within the cushioning material surrounding the rider's and passenger's ears when the helmet is worn. This is especially true if it is intended to place an earphone or loudspeaker within the ear pocket directing its sound waves into the ear. Commonly, the ear pocket has a depth equal to the thickness of the cushioning material, extending to the outer plastic, fiberglass, or metal shell comprising the helmet.

In the design of helmets, it would be desirable to have the rider's ear completely within the ear pocket with the surrounding cushioning material coming up very near to the rider's head. However, such a practice would not provide a comfortable helmet, and this is especially true when putting on or taking off the helmet, nor would such an arrangement be safe inasmuch as the ear may well be completely isolated from hearing sounds necessary to be heard, such as nearby emergency vehicles.

Accordingly, a compromise must be reached between how tightly a rider's ear may be encompassed by the ear pocket so as to reduce outside noise whereby the sound emitted from the ear pocket loudspeaker is readily understood, and the allowance of sounds from the outside environment, especially those sounds which may indicate potential danger.

In such respect, advances in motorcycle helmet design have been made in reducing noise coming in from the outside. However, advancement in the state of the art respecting loudspeakers placed into ear pockets has not been as remarkable. For example, it is entirely common today for the loudspeaker assemblies emplaced into the motorcycle helmet ear pockets to be placed within a speaker enclosure, usually a disk shaped container with a contained loudspeaker broadcasting through a plurality of small openings in one of the circular faces, the loudspeaker being situated immediately behind the circular face. It is also common to place venting holes in the rear circular face of the speaker enclosure in order that the rear chamber located behind the loudspeaker but still within the speaker enclosure, be relieved in order to improve the audio quality output of the speaker. If the rear chamber behind the loudspeaker is completely sealed, then flexing movement of the cone and diaphragm of the loudspeaker is compromised, the cone and diaphragm having the effect of compressing and decompressing the air in the rear chamber, thus putting considerable constraints upon the frequency response of the speaker cone and diaphragm, together with the power needed to drive it. To relieve the problem of compressing and decompressing the air in the rear chamber, the venting openings previously mentioned are placed in the rear face of the speaker enclosure. This bleeds the sound and pressure waves out the back of the speaker enclosure.

However, in utilizing the speaker enclosures that are presently available having rear venting openings for installation in the ear pockets, it is noted that there is considerable distortion of the primary sound waves emanating from the speaker enclosure front face as the sound waves enter the rider's ears. This is especially true in the low frequency range of sounds. The inventor has investigated this sound distortion and resultant lack of clarity and has discovered that substantially the problem lies in the sound waves emitted from the openings in rear of the speaker enclosure in that these parasitic sounds, being emitted by the backside of the loudspeaker diaphragm and cone, travel around the outside of the speaker enclosure situated within the ear pocket to impinge upon the wearer's ear and to mix with and distort the primary sounds being emitted directly from the front face of the speaker enclosure. This mixing of sound causes cancellation in some cases, amplification in other cases, but all resulting in distortion of the primary sound waves as they impinge upon the rider's ears. If this distortion problem is solved by sealing the back face of the speaker enclosure, then the primary sound emitted from the enclosure is substantially compromised. Obviously this is not the solution.

Thus it is very apparent that sound characteristics within a motorcycle helmet environment is considerably different from that presented in ordinary speaker enclosure designs where venting of the rear chamber is commonplace.

Now, it is known to vent the rear chamber of a speaker enclosure by placing openings in the enclosure wall or to place a tube interiorly to the rear chamber which provides open communication to the environment immediately outside the enclosure. The latter situation is shown in the 1932 patent of Thuras, U.S. Pat. No. 1,847,702. It is also known in earphones of the type adapted to reside within a person's ear to have a duct extending from the housing for the reason of increasing the compliance and/or equivalent mass of the vibration system to reduce the resonance frequency of the earphone. For example, Yamagishi, in the U.S. Pat. No. 4,742,887, provides such a device. Yamagishi additionally provides, at the terminal end of this duct, openings to the environment. A duct is utilized because there are no alternatives to increasing the mass in an in-the-ear earphone. Yamagishi, however, does not provide an earphone for operation in the helmet environment even though he provides a manner of removing parasitic sound waves from a speaker located in a person's ear so that they do not reach the hearer's ear or mix with the sound waves primarily issuing from the speaker.

It is readily apparent that the quality of primary sound waves reaching the listerer's ears in a helmet environment may be obviously enhanced if apparatus were available which prevented the parasitic sound waves exiting the rear of the speaker from coming around the speaker enclosure to the wearer's ear.

It is also obvious that there is need for apparatus which prevents the parasitic sound waves emanating from the rear of the speaker enclosure in a motorcycle helmet ear pocket from traveling around to the front face side of the speaker enclosure and interfering with the primary emitted sound waves.

SUMMARY OF THE INVENTION

The embodiment of the invention described consists of an acoustically shielded speaker enclosure for use in motorcycle helmets or other type of helmets worn in noisy environments wherein parasitic sound waves emanating from the rear of an audio loudspeaker contained within the enclosure and which exit from openings in the rear of the enclosure are constrained from reaching the ear of the wearer and mixing with primary sound waves issuing from the front face of the speaker enclosure. The parasitic sounds vented from the rear of the speaker enclosure are prevented from mixing with the front issued primary sound waves through the means of an acoustic shield, preferably plastic, which attaches to the cylindrical peripheral surface of the speaker enclosure and spans the distance from the speaker enclosure to the rim of the cavity which forms the ear pocket.

In construction, the subject acoustically shielded speaker enclosure comprises a circular disk having a thickness, the circular disk consisting of a pair of joined together cupped-shaped housing assemblies, i.e., a front and rear cupped-shaped housing assembly, the two housing assemblies joined at their peripheral edges to form the circular disk. The front and rear circular faces of the disk are flattened. Interiorly to the speaker enclosure formed by the joined front and rear housing assemblies is the audio loudspeaker, the loudspeaker attached with its front facing the inside surface of the front housing assembly. A plurality of openings through the circular face of the front housing assembly provides the means for sound emanating from the loudspeaker to pass through the speaker enclosure to the listener. The compartment or volume immediately behind the loudspeaker, but still within the inside of the enclosure, is defined as the rear chamber. Communicating the rear chamber with the immediate surrounding environment outside the enclosure are a plurality of small openings through the rear circular face much like the openings in the front circular face, although usually fewer in number. These rear face openings allow the rear chamber to be vented so as not to compromise the quality of the audio loudspeaker output.

In motorcycle helmets and other types of helmets, typically inside the outer shell is situated an inner protective liner having a thickness of ½ to 1 inch. Within that inner liner proximate the position of a wearer's ears, an ear pocket or cavity is formed by removal of part or all of the inner liner. The speaker enclosure is adapted to be secured within that formed ear pocket. In most cases the speaker enclosure rear outside face is attached to the inside of the helmet shell by an adhesive. Preferably, this adhesive comprises two small pieces of VELCRO, one attached to the helmet shell and the other attached to the rear face of the speaker enclosure. By this method, the speaker enclosure is removable at will.

The embodiment of the invention is a sound reflecting shield situated between the rear circular face of the speaker enclosure from which the parasitic sound waves issue and the ear of a helmet wearer. This shield comprises preferably plastic material which is attached to the peripheral cylindrical side of the speaker enclosure, i.e., the cylindrical surface between the front and the rear circular faces, and which blossoms out to overlap an annular ring of helmet liner material at the edge of the ear pocket. The plastic material forming the shield is in the preferred embodiment adhered to the helmet lining material at the edge of the ear pocket cavity.

In an alternate embodiment, the shield may itself comprise a plastic material with an attached sound absorbing material glued to it, the sound absorbing material facing inwardly the ear pocket cavity.

Thus, parasitic sound waves which emanate from the rear portion of the audio loudspeaker into the rear chamber of the speaker enclosure and exit through the openings in the speaker enclosure rear circular face are prevented from coming around the speaker enclosure to mix with the primary sound waves emitting from the front of the audio loudspeaker through the openings in the front circular face of the speaker enclosure. In such case, the parasitic sound waves are absorbed by the helmet material and the helmet liner surrounding the sides of the ear pocket cavity.

By such measures, parasitic sound waves emanating from the rear of the speaker enclosure are blocked from traveling around the speaker enclosure in the ear pocket to reach the ear of a wearer and to mix with and distort the primary sound waves emanating from the front of the speaker enclosure and thus the motorcycle rider is afforded the original sounds from the speaker enclosure, not distorted as is the present situation.

According, it is an object of the subject invention to provide an acoustically shielded speaker enclosure for motorcycle helmets wherein parasitic sound waves from the rear of the speaker are prohibited from mixing with and distorting the primary sound waves emanating from the front of the speaker enclosure.

It is another object of the subject invention to provide in a motorcycle helmet an acoustically shielded speaker enclosure wherein the parasitic sound waves from the rear chamber of the speaker enclosure are absorbed by lining surrounding the ear pocket cavity.

It is still a further object of the subject invention to provide an environment in a motorcycle helmet ear pocket whereby parasitic sounds from the rear of the speaker enclosure are prevented from coming around the enclosure to enter the ear of the wearer.

It is still a further object of the subject invention to provide an acoustically shielded speaker enclosure which removes parasitic sound waves from the rear of the speaker enclosure by means of a shield interposed the rear of the speaker enclosure and the ear of the helmet wearer.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
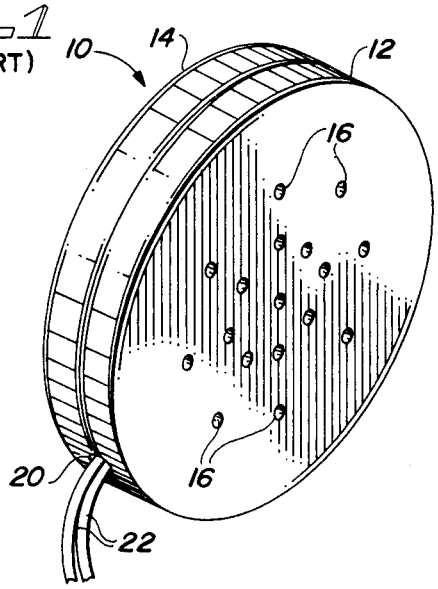
FIG. 1 (PRIOR ART)
FIG. 1. is a perspective view of the prior art speaker enclosure.

Referring now to FIG. 1, a perspective view of the prior art speaker enclosure 10 for use in motorcycle and other type helmets is shown. Primarily, the speaker enclosure comprises two joined together cupped-shaped housing assemblies, namely front housing assembly 12 and rear housing assembly 14, each preferably constructed of rigid plastic. The front and rear housing members are adapted to be joined together at the peripheral rim of their cylindrical side with an adhesive to form a volume or compartment. Situated on the flat circular disc surface of front housing 12 are a plurality of openings 16 through the wall or side of the front face, openings 16 adapted to permit the passage of sound waves issuing from an audio loudspeaker located interiorly to speaker enclosure 10, these being the primary sound waves to be heard by the helmet wearer.

Not seen in the illustration of the prior art shown in FIG. 1 are the rear openings which penetrate through the wall of the rear face which permit the exiting of parasitic sound waves which issue from the rear of the contained loudspeaker and into the rear chamber (not shown). It is these parasitic sound waves that are being prevented from mixing with the primary sound waves as the primary sound waves enter the ear of the helmet wearer. Seen emerging from the lower portion of the prior art speaker enclosure 10 of FIG. 1 are the electrical wires 22 which pass through grommet 20 which in turn is held in two half openings formed in the peripheral rims of the cylindrical sides of the front and rear housing assemblies. By use of the rubber grommet 20 surrounding the electrical wires leading to the enclosed loudspeaker, assurance is obtained that parasitic sounds do not leak from the opening formed to receive grommet 20, and that the electrical wires are rot accidentally crimped when the speaker enclosure is assembled.

Figure 2:
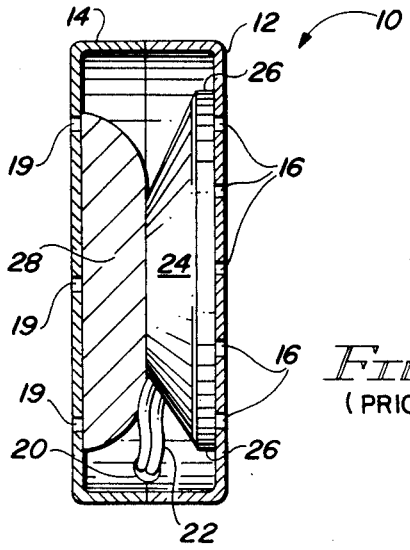
FIG. 2 (PRIOR ART)
FIG. 2. is a cross-sectional view of the prior art speaker enclosure.

FIG. 2 is a cross-sectional view of the prior art speaker enclosure 10 disclosing the elements interiorly to the enclosure. Audio loudspeaker 24 is shown proximate openings 16 in the front circular face of front housing 12, speaker 24 attached to the inside flat circular surface of cupped shaped front housing 12 by means of a circular grommet 26. Grommet 26, in the preferred embodiment, comprises a rubber ring operably attached by adhesives on one side to the inside face surface of housing 12 and on its other side to the peripheral rim of loudspeaker 24. Grommet 26 serves to seal the front sound emitting portion of speaker 24 to the flat circular face of enclosure 12 to form the front chamber in that the primary sound waves issuing from speaker 24 should pass only through the openings 16. Thus grommet 26 also prevents sound waves emanating from the front output of speaker 24 from entering the rear chamber, i.e., that portion of the speaker enclosure behind audio loudspeaker 24.

Situated in the rear chamber portion of speaker enclosure 10, i.e., that portion behind (to the left of) loudspeaker 24, are openings 19 formed in the sides or walls of the rear circular face of rear housing assembly 14. Rubber foam 28 immediately behind speaker 24 serves the purpose of helping to secure speaker 24 in place and to absorb a portion of the unwanted parasitic sound waves which emanate from the rear output of the speaker 24. In the bottom of the drawing are the pair of electrical leads 22 which are connected to speaker 24 and which pass outside of speaker enclosure 10 through the opening sealed by grommet 20.

Figure 3:
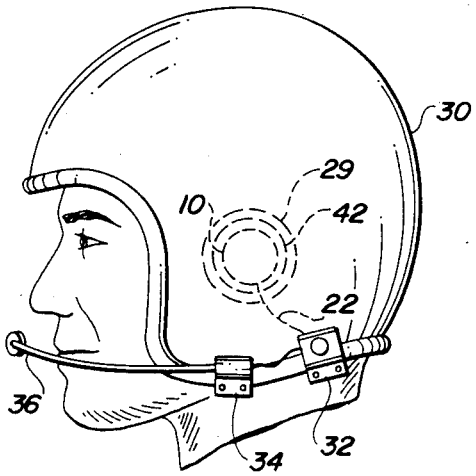
FIG. 3. is a side elevation view of a motorcycle rider wearing a motorcycle helmet with the subject invention situated therein.

Referring now to FIG. 3, a side elevational view is shown of a motorcycle rider utilizing the invention in motorcycle helmet 30, the location of the speaker enclosure 10 shown in dotted fashion in ear pocket 42 formed in the cushion lining of the helmet. Also shown in FIG. 3 are electrical leads 22 emerging from speaker enclosure 10. Shown surrounding speaker enclosure 10 is the invention herein, namely acoustic shield 29 which is attached at its inside point to the cylindrical peripheral side of speaker enclosure 10 and on its outer circular periphery to the helmet lining immediately surrounding ear pocket 42. Thus, it is obvious that parasitic sounds emerging from the rear of the speaker enclosure 10 are prevented from coming around speaker enclosure 10 to mix with and distort the parasitic sound waves being heard by the wearer. These parasitic sound waves are then absorbed into the liner material which surrounds the ear pocket or helmet material itself, although the helmet, being hard, most likely will absorb only small amounts of the parasitic sound waves. Lastly shown in FIG. 3 are the electrical lead lines 22 which pass from speaker enclosure 10 to mounting bracket 32. Mounting bracket 32, which also receives the electrical lead line from the radio transmitter set located on the motorcycle, further directs an electrical line to the microphone boom mount bracket 34 which secures microphone boom 36.

It is realized of course that there will be a total of two speaker enclosures 10 in each helmet, one for each of the rider's ears, both also employing the acoustic shield 29.

Figure 4:
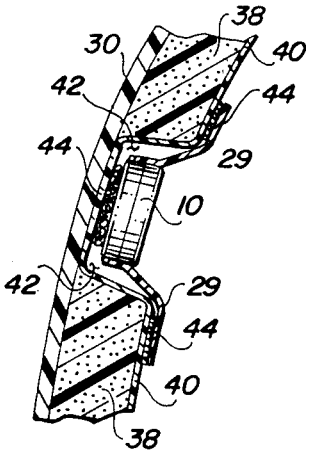
FIG. 4. is a cross-sectional view of the subject inventive acoustically shielded speaker enclosure in a motorcycle helmet.

Referring now to FIG. 4, a partial cross-sectional view of helmet 30 showing the invention in place in the helmet is detailed. Motorcycle safety helmets are typically manufactured having a hardened outer shell, shown by the numeral 30, commonly composed of a very durable plastic or resin composition, and an inner cushion, such as that enumerated 38, which may have a thickness of ½ to 1 inch, and lastly an inner liner 40, which generally comprises a plastic or cloth material. The inner cushion is attached to the outer shell by an adhesive and the inner liner similarly attached to the inner cushion with an adhesive. Formed within the inner cushion 38 is the ear pocket 42 cavity wherein the inner cushion has been removed, or a substantial portion of the inner cushion has been removed, in order to receive firstly, the rider's ears, and secondly, other apparatus such as earphones or the like. Here the acoustically shielded speaker enclosure 10 is attached to the helmet shell 30 by an adhesive or, more commonly, VELCRO type fastener 44.

By the construction of the ear pocket and the location of the invention at the ear pocket shown in FIG. 4, the rider's ear resides in the ear pocket or just at its edge in the inner cushion, and the speaker enclosure 10 is directed straight into the ear. It is not intended that the speaker enclosure 10 should actually touch the ear, although it will be situated a quarter to half inch away from it. As mentioned earlier, the problem which exists with the prior art motorcycle helmet earphones and speaker enclosures is that parasitic sound waves which emanate from the rear chamber of the speaker enclosure, usually from rear venting holes in the face of the rear housing portion, and especially those parasitic sound waves in the low frequency range, bounce off the helmet shell to reach the wearer's ear or come back into and interfere with the primary sound waves emitted from the front output portion of the speaker enclosure. This causes cancellation and/or reinforcement of the sound waves emanating from the front housing assembly of the speaker enclosure. Thus, in the prior art, there was degradation of the sound entering the ear of the motorcycle rider making the audio difficult to understand and causing different types of distortion with different frequencies of sound so that it was not possible to avoid the problem by electronically adjusting or modifying the sound in accordance with its particular frequency.

In the subject invention the problem alluded to above is alleviated by assuring that the unwanted sound waves emanating from the rear of the speaker inside the speaker enclosure do not have opportunity to come around the speaker enclosure to mix with and distort the primary sound waves. This is accomplished by placing a sound reflecting acoustic shield between the rear of the speaker enclosure and the exterior of the ear pocket. More specifically, annularly shaped acoustic shield 29 is shown having its inner circularly shaped edge attached to the cylindrical side of speaker enclosure 10 with the outer circular edge attached to the helmet inner liner 40. Acoustic shield 29, preferably being constructed of thin pliable plastic, is firstly adhered around the cylindrical peripheral side of speaker enclosure 10 with an adhesive, and is similarly attached to the helmet liner material 40 just at the edge of ear pocket cavity 42 also with an appropriate adhesive. Since acoustic shield 29 completely surrounds the speaker enclosure, being attached at its cylindrical periphery, and is also similarly attached around the abutting or peripheral edge of the ear pocket, parasitic sound waves emitting from the openings in the rear face of the speaker enclosure are blocked and thus prevented from interfering with and mixing with the primary sound waves to distort them prior to their entrance into the wearer's ear.

Figure 5:
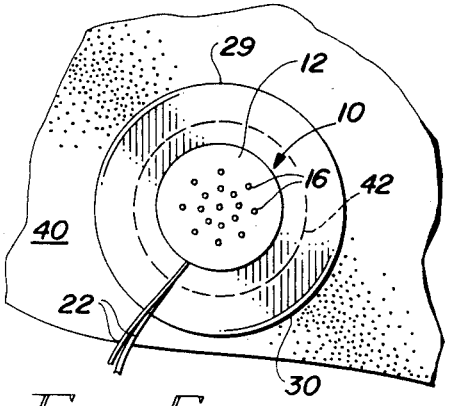
FIG. 5. is a front perspective view of the inventive acoustically shielded speaker enclosure in a motorcycle helmet.

In FIG. 5, a front view is shown taken of a portion of helmet 30 looking directly at the subject inventive speaker enclosure 10 with acoustic shield 29 situated in the ear pocket 42 formed in the helmet cushion and lining 40. More specifically, cup-shaped front housing 12 of speaker enclosure 10 is shown in a front view disclosing its circular face with openings 16 which permit the emergence of primary sound waves from the interior speaker (not shown) to the rider's ear (not shown). Surrounding the speaker enclosure 10 are the walls of ear pocket 42 (dotted). Connecting with the outer cylindrical peripheral surface of speaker enclosure 10 is the acoustic shield 29 which blossoms out to encompass the edge of ear pocket 42 (shown dotted) to be adhered to the helmet lining 40 surrounding ear pocket 42. As is seen, the outer circular edge of acoustic shield 29 1ust encompasses the very edge of ear pocket 42 only an area sufficient to assure a good adherence to the lining material 40 (perhaps ½ to 1 inch).

Shown emerging from the bottom edge of acoustic shield 29 are the electrical leads 22 which drop below the edge of the helmet to make connection with the mounting hardware shown in FIG. 3. Electrical leads 22 thus will present a break between the helmet lining 40 and the adhesive attached to the underside of acoustic shield 29, however, if the acoustic shield is pressed firmly around electrical leads 22 when it is glued to helmet lining 40, vary little opportunity is afforded for sound waves to pass through any cracks or openings. As shown in FIG. 5, electrical leads 22 continue under acoustic shield 29 down into pocket 42 to enter speaker enclosure 10.

Figure 6:
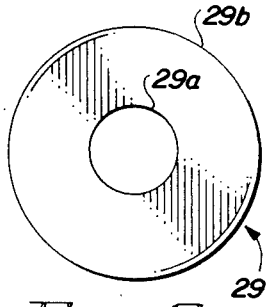
FIG. 6. is a top view of the acoustic shield employed in the invention.

Referring now to FIG. 6, a top view of annularly shaped acoustic shield 29 is shown before the speaker enclosure has been attached to its inner circle and before it in turn has been placed surrounding the ear pocket. Acoustic shield 29 is a piece of thin pliable plastic material which does have some qualities of elasticity since it is intended that the diameter of the inner circle 29*a* should be less than the diameter of the speaker enclosure so that acoustic shield 29 stretches somewhat to be tightly secured around the cylindrical sides of the speaker enclosure whereupon the acoustic shield is worn much like a hat. Preferably, an adhesive is placed upon the plastic material juxtaposed the inner diameter 29*a*, perhaps forming a width of ¼ to ½ inch in order that, when acoustic shield 29 is fit over the speaker enclosure, it not only is held by the compression or tightness of the plastic, but also by the adhesive placed on the shield.

Around the outer rim 29b of the shield, also perhaps having a width of ½ to 1 inch, is placed another annularly shaped band of adhesive, this latter adhesive adapted to be joined to the helmet material surrounding the ear pocket. It is obvious that the adhesive surrounding the inner diameter 29a will be on one side of the plastic material and the adhesive next to the outer diameter 29b will be on the opposite side of the plastic. When a speaker enclosure is secured in the diameter 29a of the acoustic shield 29, the shield will take on somewhat the appearance of a flower, blossoming out circularly around the inner central part, the speaker enclosure.

Figure 7:
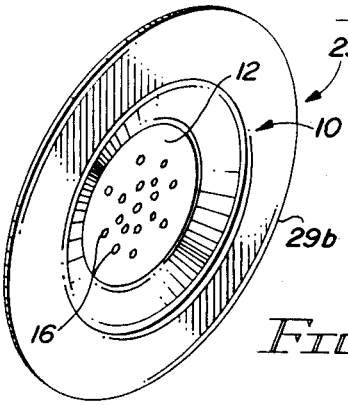
FIG. 7. is a perspective view of the speaker enclosure and acoustic shield out of a motorcycle helmet.

FIG. 7 is a perspective view of acoustic shield 29 enclosing speaker enclosure 10 without a helmet. Shown in FIG. 7 is the front circular face 12 of speaker enclosure 10 and the front openings 16 through front face 12. At the outer periphery of acoustic 29 is its outer diameter 29b.

Figure 8:
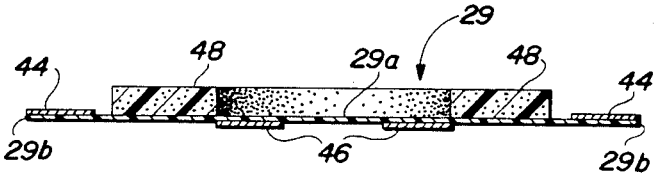
FIG. 8. is a cross-sectional view of the acoustic shield in an alternate embodiment.

Lastly, FIG. 8 shows a cross-sectional view of acoustic shield 29 taken through its center and showing an alternate embodiment. Firstly, at the very edge of the sound reflecting acoustic shield 29 is the outer peripheral edge 29b and juxtaposed to it an annular band of adhesive 44 for attachment to the helmet liner. Then, surrounding the interior diameter 29a is a second annular band of adhesive 46, adhesive 46 adapted to apply to the cylindrical side of the speaker enclosure. Then, between the two bands of adhesive is an annularly shaped sound absorbing material 48 designed to absorb parasitic sounds waves which may be attempting to come around the speaker enclosures to mix with the primarily issued sound waves. Such an addition provides more assurance that parasitic sound waves do not cross the acoustic shield barrier. The addition of the annularly shaped sound absorbent material 48, such as a dense cloth material, is an alternate embodiment of the invention. Use of the circular bands of adhesive 44 and 46 are elements of the preferred embodiment of the invention.

It is also readily apparent that since the purpose of the acoustic shield is to prevent passage of the parasitic sound waves, a sound absorbent material, such as a heavy, dense cloth, could also be substituted for the plastic sound-reflecting material 30 shown in FIGS. 3–8.

While a preferred embodiment of the invention, together with an alternate embodiment, has been shown and described, it is appreciated that other such embodiments of the invention are possible and that there is no intent to limit the invention by such disclosure, but rather it is intended to cover all modifications and alternate embodiments falling within the spirit and the scope of the invention as defined in the appended claims.

I claim:

1. In a motorcycle helmet having an interior lining, an acoustically shielded speaker enclosure for preventing mixing of parasitic sound waves with primary sound waves issuing from the speaker enclosure, the speaker enclosure comprising:

a front and rear cup-shaped housing assembly, said front and rear housing assembly joined together to form a speaker enclosure, each said housing assemblies having a circular face;

an audio loudspeaker secured interiorly to said front cup-shaped housing assembly, said loudspeaker having a front output side and a rear output side, primary sound waves issuing from said loudspeaker front output side and parasitic sound waves issuing from said loudspeaker rear output side;

a plurality of first openings through said circular face of said front cup-shaped housing assembly proximate said loudspeaker front output side to permit exiting of primary sound waves from said speaker enclosure;

a plurality of second openings through said circular face of said rear cup-shaped housing assembly proximate said loudspeaker rear output side to permit exiting of the parasitic sound waves from said speaker enclosure; and an acoustic shield operably attached to said speaker enclosure, said acoustic shield defining flexible material so situated to prevent the parasitic sound waves exiting said second openings from mixing with the primary sound waves exiting said first openings of said speaker enclosure front housing assembly circular face.

2. The acoustically shielded speaker enclosure as defined in claim 1 wherein said acoustic shield is also operably attached to the associated helmet inner lining.

3. The acoustically shielded speaker enclosure as defined in claim 2 wherein the associated helmet inner liner includes at least one ear pocket in the inner liner of the helmet, and said speaker enclosure is located within the associated helmet ear pocket.

4. The acoustically shielded speaker enclosure as defined in claim 3 wherein the ear pocket in the inner liner of the associated helmet has an abutting edge defining the ear pocket, and said acoustic shield is operably attached to the abutting edge of the associated helmet inner liner ear pocket.

5. The acoustically shielded speaker enclosure as defined in claim 4 wherein said speaker enclosure joined front and rear cup-shaped assembly define in part a cylindrical periphery and said acoustic shield operably attached to said speaker enclosure includes said acoustic shield attached to said cylindrical periphery of speaker enclosure.

6. The acoustically shielded speaker enclosure as defined in claim 5 wherein said acoustic shield is attached to said speaker enclosure cylindrical periphery with an adhesive and said acoustic shield is attached to the associated helmet liner ear pocket edge with an adhesive.

7. The acoustically shielded speaker enclosure as defined in claim 6 wherein said flexible material acoustic shield defines an annularly shaped piece of flexible plastic having an inner and outer diameter, an annularly shaped inner band of adhesive proximate said inner diameter, and an annularly shaped outer band of adhesive proximate said outer diameter, said inner and outer bands of adhesive attaching said plastic material to said speaker enclosure and the associated helmet liner ear pocket abutting edge respectively.

8. The acoustically shielded speaker enclosure as defined in claim 7 wherein said acoustic shield further includes an annular band of acoustic absorbing material attached to said plastic, said acoustic absorbing material situated between said inner and said outer bands of adhesive.

9. The acoustically shielded speaker enclosure as defined in claim 5 wherein said acoustic shield defines an annularly shaped piece of flexible material which is sound reflective.

10. The acoustically shielded speaker enclosure as defined in claim 5 wherein said acoustic shield defines an annularly shaped piece of flexible material which is sound absorbing.

11. An improvement in a speaker enclosure for use in motorcycles helmets for enhancement of sound waves entering an ear of a helmet wearer, the speaker enclosure having a front and rear face, and cylindrical side, a contained audio loudspeaker with a front output side and a rear output side, the loudspeaker front output side juxtaposed the speaker enclosure front face and issuing primary sound waves and the rear output side issuing parasitic sound waves, a plurality of first openings in the speaker enclosure front face proximate the front output side of the loudspeaker permitting exiting of primary sound waves from the speaker enclosure front face, a plurality of second openings in the speaker enclosure rear face proximate the rear output side of the loudspeaker permitting exiting of parasitic sound waves from the speaker enclosure rear face, the improvement comprising;

an acoustic shield to prevent the primary sound waves exiting the speaker enclosure front face from mixing with the parasitic sound waves exiting the speaker enclosure rear face, said acoustic shield defining a flexible material operably attached to the speaker enclosure cylindrical side to thereby block the parasitic sound waves whereby parasitic sound waves are prevented from mixing with the primary sound waves and thereby distort the primary sound waves entering the ear of a helmet wearer.

12. The improvement in speaker enclosures for use in motorcycle helmets as defined in claim 11 wherein the an motorcycle helmets include an inner liner, and said acoustic shield is further operably attached to the motorcycle helmets inner liner.

13. The improvement in speaker enclosures for use in motorcycle helmets as defined in claim 12 wherein the motorcycle helmets inner liner further includes an ear pocket formed in the inner liner, the ear pocket defined by an abutting edge, and said acoustic shield operably attached to the inner liner is operably attached to the abutting edge defining the helmets inner liner ear pocket.

14. In combination, a protective helmet and a cup-shaped speaker enclosure having a front face, a rear face, and cylindrical side, the combination enhancing sound waves from the speaker enclosure entering the ear of a helmet wearer by avoiding mixing of primary sound waves issuing from the speaker enclosure front face with parasitic sound waves issuing from the speaker enclosure rear face, the combination comprising;

a protective helmet having an inner liner, said inner liner having formed therein at least one ear pocket proximate an ear of a wearer; and a speaker enclosure situated interiorly to said ear pocket, said speaker enclosure including an operably attached acoustic shield blocking the parasitic sound waves issuing said speaker enclosure whereby the parasitic sound waves will not mix with the primary sound waves issuing from said speaker enclosure.

15. The combination as defined in claim 14 wherein said acoustic shield blocking the parasitic sound waves issuing said speaker enclosure includes a flexible material acoustic shield.

16. The combination as defined in claim 15 wherein said acoustic shield is operably attached to said speaker enclosure cylindrical side.

17. The combination as defined in claim 16 wherein said acoustic shield is further operably attached to said helmet liner proximate said ear pocket.

18. The combination as defined in claim 17 wherein said acoustic shield operably attached to said speaker enclosure cylindrical side and to said inner liner proximate said ear pocket is attached to said speaker enclosure and to said inner liner by an adhesive.

* * * * *